United States Patent [19]

Nashiwa et al.

[11] 4,325,748

[45] Apr. 20, 1982

[54] METHOD FOR PRODUCING STEEL PLATE HAVING EXCELLENT RESISTANCE TO HYDROGEN INDUCED CRACKING

[75] Inventors: Hajime Nashiwa, Sakai; Toshihiko Kawai, Wakayama; Muneyoshi Takeyama, Wakayama; Youzi Yamaguchi, Wakayama; Tsuneaki Kobayashi; Tsutomu Nagahata, both of Osaka, all of Japan

[73] Assignee: Sumitomo Metal Industries, Ltd., Osaka, Japan

[21] Appl. No.: 134,579

[22] Filed: Mar. 27, 1980

[30] Foreign Application Priority Data

Mar. 28, 1979 [JP] Japan ..... 54-37593

[51] Int. Cl.[3] ..... C21D 8/00

[52] U.S. Cl. ..... 148/2; 148/12 F

[58] Field of Search ..... 148/12 F, 2, 36, 12 C, 148/12.4; 75/124, 123 J

[56] References Cited

U.S. PATENT DOCUMENTS

| | | | |
|---|---|---|---|
| 3,328,211 | 6/1967 | Nakamura | 148/12 |
| 3,897,279 | 7/1975 | Shaughnessy et al. | 148/12 F |
| 4,138,278 | 2/1979 | Nakasugi et al. | 148/12 F X |
| 4,153,454 | 5/1979 | Emi et al. | 75/124 |

OTHER PUBLICATIONS

Ohi et al., "Influence of Metallurgical Factors on Hydrogen Induced Cracking of Steel Sheet," *Tetsu to Koh* 63 Sep. 1977, S708.

Yamamori et al., "Resistance to Hydrogen Induced Cracking of Line Pipe by Addition of Ca" *Tetsu to Koh* 64, Mar. 1978, S289.

Terasaki, et al., "A Study of Factors Having Effect on Susceptivity to Hydrogen Induced Cracking and $H_2$ Absorbing Props. of Line Pipe," Tetsu to Koh, 64, Sep., 1978, S836.

Inagaki et al., "Improvement of Resistance to $H_2$ Induced Cracking by Controlled Transformed Structure," *Tetsu to Koh* 64 Sep. 1978, S838.

*Primary Examiner*—Peter K. Skiff

*Attorney, Agent, or Firm*—Wenderoth, Lind & Ponack

[57] ABSTRACT

Steel plate having an excellent resistance to hydrogen induced cracking is obtained from a continuously cast slab having the following composition, C 0.01–0.30% by weight, Si 0.05–0.60% by weight, Mn 0.40–2.50% by weight, Sol Al 0.005–1.00% by weight, S 0.003% and lower by weight, the weight ratio of Ca/S is 2–10, the remainder being substantially Fe, through the steps of hot primary reduction rolling the cast slab, heating it at the temperature of 1200° C. or higher for 10 hours or longer, and ordinary rolling it.

5 Claims, 5 Drawing Figures

(x 100)

(x 100)

METHOD FOR PRODUCING STEEL PLATE HAVING EXCELLENT RESISTANCE TO HYDROGEN INDUCED CRACKING

BACKGROUND OF THE INVENTION

The present invention relates to a method for producing a structural steel plate for a welded steel pipe for conveying a fluid containing wet hydrogen sulfide such, for example, as natural gas or crude oil containing $H_2S$, or for a tank for storing such fluid, and provides a method for producing a steel plate having an excellent resistance to cracking due to wet hydrogen sulfide, commonly referred to as hydrogen induced cracking.

Welded steel pipes and steel tanks have been used for conveying or storing natural gas or crude oil. With the recent progress in development of fields producing crude oil and natural gas having relatively high contents of hydron sulfides, there has been an increasing demand for steel pipes and tanks which are highly resistant to hydrogen induced cracking, for conveying such crude oil or natural gas. Particularly, large-diameter steel pipes for conveying, usually referred to as line pipes, are required to be as low in cost and as high in quality as possible because a vast amount of the pipes are needed for construction of the conveying pipe lines. In recent years the requirement has become increasingly severe. In fact, steel plates that are prevented from cracking under a severe condition such as low PH ($<5.0$) are demanded in some cases.

A steel pipe for line pipe is presently produced from a hot rolled steel plate manufactured from a continuously cast steel material (or a large steel ingot) by shaping and welding the plate. Particularly in a continuously cast slab, however, there is caused in the course of solidification a segregation generally referred to as a central segregation in the slab thickness center in which the concentration of impurities such as C, Mn, P, S and the like is high, and the central segregation remains in the neighborhood of the center of thickness of the rolled steel plate to increase susceptibility to hydrogen induced cracking of that portion.

Although many attempts were made to control the steel making conditions and to develop new steel making methods, none of them was successful in substantially solving the abovementioned problem. That is, such attempts were made to prevent hydrogen induced cracking as, (I) addition of alloying elements (such as Cu and the like) to thereby inhibit penetration of hydrogen, (II) reduction of S content or proper addition of rare earth elements (REM) or Ca (for spheroidization of inclusions) to thereby reduce the number of possible cracking points, and (III) control of rolling and heat treating conditions to thereby improve the steel structure, but none of them has proved entirely satisfactory. At present, it is considered technically difficult to completely prevent hydrogen induced cracking of continuously cast steel or any other steel material in a severe environment such as low PH condition.

SUMMARY OF THE INVENTION

In view of the disadvantages of the conventional methods mentioned above, an object of the present invention is to reduce central segregation, particularly, in continuously cast material, and to provide a method for producing steel materials that are prevented from hydrogen induced cracking under low PH and other severe environment conditions.

The method for producing a steel plate having an excellent resistance to hydrogen induced cracking according to the present invention is characterized in that a continuously cast slab having the basic composition of C 0.01–0.30% by weight, Si 0.05–0.60% by weight, Mn 0.40–2.50% by weight, and Sol Al 0.005–1.00% by weight, to which S (0.003% by weight or lower) and Ca (regulated in content so that the weight ratio Ca/S is in the range 2–10) and, when necessary, other elements are added, the remainder being substantially Fe, is hot light reduction rolled, heated at the temperature of 1200° C. or higher for 10 hours or longer, and then ordinary rolled.

The reason for the limitation of the contents of the basic components in the steel according to the present invention will now be explained. The C content is limited to 0.01–0.30% by weight because the C content less than 0.01% by weight causes difficulties in securing the required strength and in making steel and because the C content more than 0.30% by weight causes a problem in weldability. The Si content is limited to 0.05–0.60% by weight because the Si content of 0.05% is the irreducible minimum requirement for killed steel and, on the other hand, the upper limit is determined to be 0.60% by weight in view of low temperature toughness. The Mn content is limited to 0.40–2.50% by weight because the Mn content of 0.40% by weight is the irreducible minimum requirement in view of strength and the Mn content exceeding 2.50% by weight causes the toughness to be deteriorated. The Sol Al content is limited to 0.005–1.00% by weight because its content of 0.005% by weight is the irreducible minimum requirement for deoxidation of killed steel and its content exceeding 1.00% by weight is not preferable in view of the deterioration in toughness and the production of surface defects. S is an element having sensitive effects on the resistance to hydrogen induced cracking and its content exceeding 0.003% by weight increases MnS which can represent origins of the cracking to thereby make it difficult to secure sufficient resistance to hydrogen induced cracking. In addition of rare metal elements (REM) or Ca for spheroidization of non-metallic inclusions, the Ca content is so controlled that the weight ratio of Ca/S becomes 2–10 because in the ratio of Ca/S lower than 2 MnS remains as origins of cracking and in the ratio of Ca/S higher than 10 large inclusions containing Ca increase to thereby ruin the cleanliness of the steel. Accordingly, Ca is contained usually in the range of 0.0020–0.0100% by weight.

The steel according to the present invention may contain, in addition to the components mentioned above, one or more other components to be described below as required. Nb and V may be added in the ranges of 0.06% by weight or lower and 0.10% by weight or lower, respectively, to increase the low temperature toughness and the strength. Cu may be added in the range of 0.5% by weight or lower to inhibit the penetration of hydrogen in the hydrogen sulfide atmosphere and to increase the strength. Ni is an element effective to increase the toughness and can be added in the range of 9.5% by weight or lower. Cr may be added in the range of 1.0% by weight or lower to increase the strength and the hardenability. Other elements such as B, Mo, Ti and the like may be added as required.

The continuously cast slab having the above-described components is cut into predetermined length, heated, immediately or after being cooled, to temperatures ranging from 1100° to 1300° C. in a heating furnace, and then subjected to primary reduction rolling. In this rolling step, it is essential that the slab is reduced in thickness to one half or less of the initial slab thickness (*to*). The effect of this light reduction rolling is multiplied by the effect of the below-described high temperature long time heating and constitutes an essential factor for reducing the central segregation.

The primary reduction rolled slab is, immediately or after being cooled, charged into the heating furnace again, in which it is subjected to heating at 1200° C. or above for 10 hours or longer, then the slab is hot rolled under usual conditions into a product.

The inventors have found that the above-outlined production method provides steel plates having excellent resistance to hydrogen induced cracking which are prevented from hydrogen induced cracking even under low PH or other severe conditions.

In the method according to the present invention, the central segregation is considerably reduced by the light reduction rolling (to *to*/2 or smaller) combined with the high temperature long time heating (1200° C. or above for 10 hours or longer). In this method, in any case where the primary reduction is less than *to*/2, or the heating temperature is lower than 1200° C., or the heating time is shorter than 10 hours, no practical improvement in resistance to hydrogen induced cracking is obtained. In the primary reduction, while the draft is preferably as high as possible, the minimum requirement is the rolling to the thickness of *to*/2. On the other hand, in view of the fact that too much reduction in the thickness of the product will lead to larger scale loss during high temperature long time heating, or will make it more difficult to secure the mechanical properties of the product after the final rolling, the slab thickness of the light reduction is preferably in the range from *to*/3 to *to*/2.

The heating temperature is determined to be 1200° C. or higher because at the temperature lower than 1200° C. a longer heating time is required, resulting in a lower productivity.

While the upper limit of the heating temperature is not specified hereinabove, it is determined considering the capacity of the heating furnace and the melting state of the slab to approximately 1360° C. usually. The heating time is determined to be 10 hours or longer because the heating time shorter than that is insufficient to obtain the desired effect to prevent hydrogen induced cracking. While the upper limit of the heating time is not specified, it is preferably 24 hours because the heating effect becomes saturated in about 24 hours and no particular effect is obtained by heating longer than 24 hours.

The invention will be better understood from the following detailed description taken in connection with the accompanying drawings.

DETAILED DESCRIPTION OF THE PREFERRED EMBODIMENTS

Figure 1A:
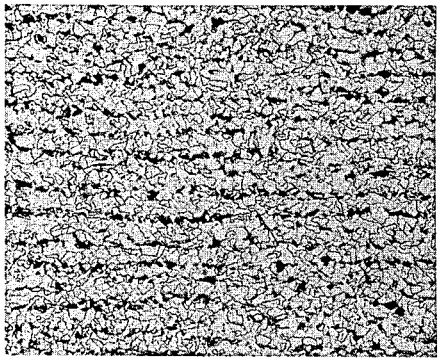
FIG. 1A is a photograph showing a microstructure of a steel plate according to the present invention at the center of the thickness of the plate (corresponding to the position of central segregation)

The preferred embodiments of the present invention will now be described in detail with reference to the tables included herein and to the accompanying drawings.

The table 1 shows the chemical composition of each of the steels A and B according to the present invention and the comparative steel C. The steel A according to the present invention was obtained from continuously cast slabs of thicknesses of 200 mm and 370 mm, respectively, by cutting them into a predetermined length, heating them at 1250° C. for three hours, and then primary reduction rolling them into slabs of thicknesses of 100 mm and 180 mm, respectively. The steel B according to the present invention was obtained from a continuously cast slab of the thickness of 300 mm by cutting it into a predetermined length, heating it at 1250° C. for three hours, and then forming it into slabs of thicknesses of 150 mm and 120 mm (and, for comparison 220 mm and 180 mm), respectively, by primary reduction rolling. The comparative steel C was obtained from a continuously cast slab of the thickness of 300 mm by cutting it into a predetermined length, heating it at 1250° C. for three hours, and forming it into a slab of a thickness of 150 mm by primary reduction rolling.

TABLE 1

| | Mark | Thickness of Continuously Cast Slab (mm) | Chemical Composition (wt%) C | Si | Mn | P | S | Nb | V | Sol Al | Ca | Ca/S |
|---|---|---|---|---|---|---|---|---|---|---|---|---|
| Present Invention | A | 200 | | | | | | | | | | |
| | | 370 | 0.08 | 0.31 | 1.45 | 0.021 | 0.002 | 0.02 | 0.05 | 0.036 | 0.0045 | 2.25 |
| | B | 300 | 0.15 | 0.38 | 1.36 | 0.016 | 0.002 | — | 0.05 | 0.023 | 0.0056 | 2.80 |
| Comparative Steel | C | 300 | 0.08 | 0.30 | 1.28 | 0.020 | 0.006 | 0.02 | 0.05 | 0.041 | | |

Each of the slabs after primary reduction rolling was reheated at 1250° C. for 10 hours and hot rolled into steel plates of a thickness of 23.5 mm.

For comparison, the continuously cast slabs A, B and C were cut into a predetermined length, heated at 1250° C. for 10 hours or at 1250° C. for three hours without reducing their thickness, and then hot rolled into steel plates of the thickness of 23.5 mm. The conditions for this operation are shown in Table 2.

TABLE 2

| | Initial Thickness of Slab (mm) | Mark | No. | Primary Reduction Rolling (mm) | Heating Before Final Rolling 1250° C. × 3hr | Heating Before Final Rolling 1250° C. × 10hr | Final Rolling (mm) |
|---|---|---|---|---|---|---|---|
| Present Invention | | | 1 | 200 → 100 | — | o | 100 → 23.5 |
| Comparative Method | 200 | | 2 | — | — | o | 200 → 23.5 |
| | | | 3 | — | o | — | 200 → 23.5 |
| Present Invention | | A | 4 | 370 → 180 | — | o | 180 → 23.5 |
| Comparative Method | 370 | | 5 | — | — | o | 370 → 23.5 |
| | | | 6 | — | o | — | 370 → 23.5 |
| Present Invention | | | 1 | 300 → 120 | — | o | 120 → 23.5 |
| | | | 2 | 300 → 150 | — | o | 150 → 23.5 |
| | 300 | B | 3 | 300 → 180 | — | o | 180 → 23.5 |
| Comparative Method | | | 4 | 300 → 220 | — | o | 220 → 23.5 |
| | | | 5 | — | — | o | 300 → 23.5 |
| | | | 6 | — | o | — | 300 → 23.5 |
| | | | 1 | 300 → 150 | — | o | 150 → 23.5 |
| Comparative Method | 300 | C | 2 | — | — | o | 300 → 23.5 |
| | | | 3 | — | o | — | 300 → 23.5 |

Figure 1B:
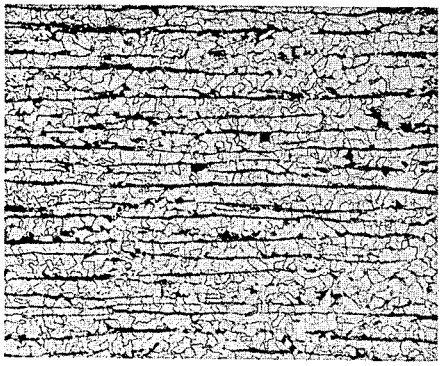
FIG. 1B is a photograph similar to that of FIG. 1A, showing a microstructure of a steel plate according to a conventional method.

A microstructure of the steel plate according to the present invention at the center in thickness (the position corresponding to the central segregates) is shown in FIG. 1A. For comparison's sake, a similar microstructure of a steel plate obtained by a conventional method is shown in FIG. 1B.

Figure 2:
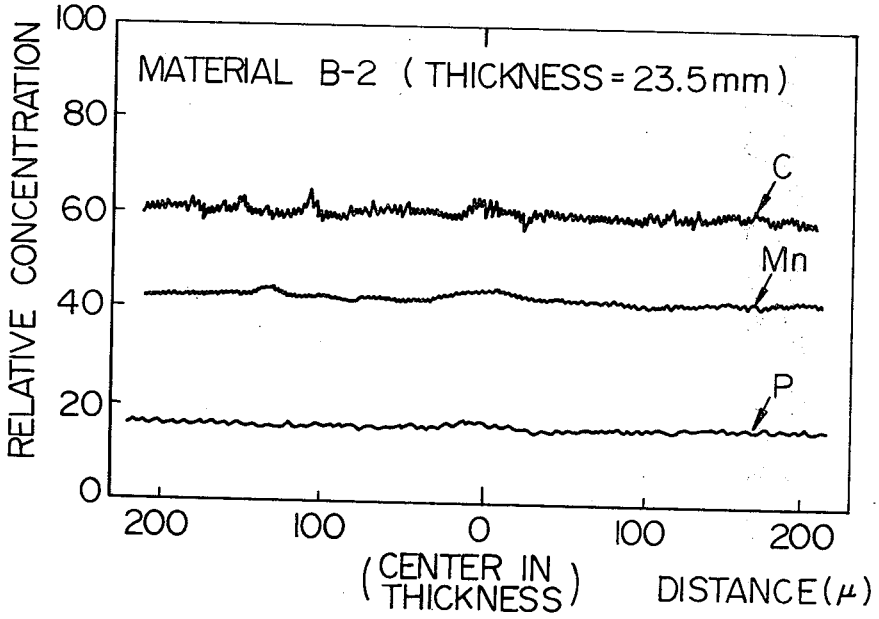
FIG. 2 is a diagram showing the result of EPMA lineal analysis of the concentration distribution of C, Mn and P in the thickness direction of the steel plate according to the present invention.
Figure 3:
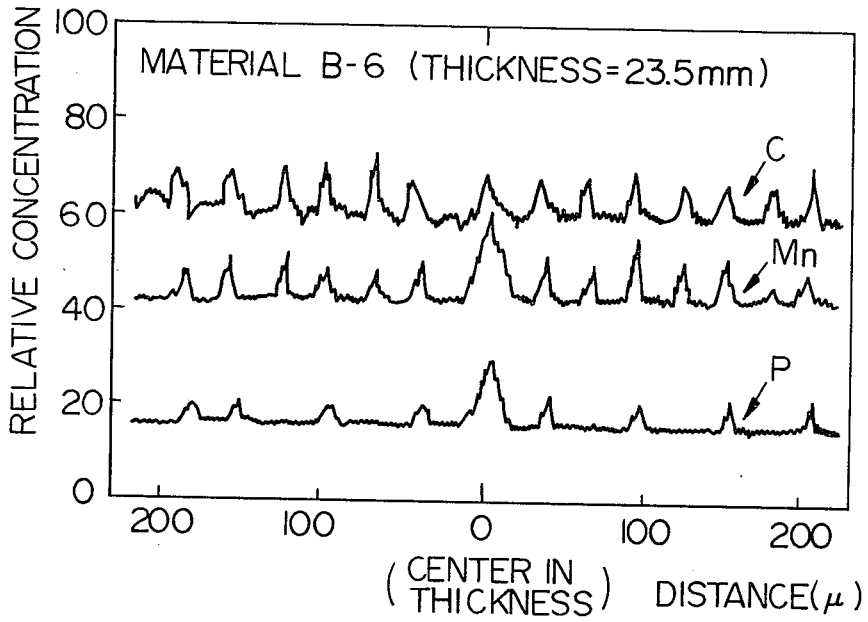
FIG. 3 is a diagram similar to that of FIG. 2, showing the properties of the steel plate according to the conventional method.

As shown in FIG. 1A, the steel plate according to the present invention (B-1 in Table 2) is of a good microstructure in which banded structure is not found. In contrast to this, in the steel plate according to the conventional method (B-6 in Table 2) as shown in FIG. 1B, the banded structure is clearly distinguished. This agrees with the results of X-ray analysis using an electron probe microanalyzer (EPMA) of the distribution of concentrations of C, Mn and P in the thickness direction as shown in FIGS. 2 and 3, proving that the method according to the present invention has a significant effect in reducing segregation of C, Mn and P in the central region in the thickness of the steel plate.

Table 3 shows the comparison in mechanical properties between the steel plate B-2 according to the present invention and the steel plate B-6 according to the conventional method. As seen from Table 3, the steel plate B-2 has superior properties to the steel B-6.

TABLE 3

| | Mark | Heat Treatment | API Tension (T direction) Yield Point ($Kg/mm^2$) | Tensile Strength ($Kg/mm^2$) | Elongation (%) | 2mm V Charpy Test (T direction) vEo (Kgm) | vTs (°C.) |
|---|---|---|---|---|---|---|---|
| Present Invention | B-2 | Just Rolled | 42.8 | 53.2 | 38.9 | 25.1 | −58 |
| | | Hardened and Tempered* | 52.5 | 62.6 | 34.8 | 28.5 | −75 |
| Conventional Method | B-6 | Just Rolled | 40.2 | 51.4 | 35.2 | 22.0 | −43 |
| | | Hardened and Tempered* | 52.3 | 63.1 | 29.7 | 24.8 | −62 |

*Heat Treatment Conditions: 920° C. × 60 min. WQ → 620° C. × 60 min. AC

Hydrogen induced cracking tests were conducted on the steel plates shown in Table 2 under the conditions shown in Table 4.

TABLE 4

| Immersion Condition | PH | $H_2S$ Concentration (ppm) | Solution Temperature (°C.) | Immersion Time (hr) | Shape of Test Piece (mm) |
|---|---|---|---|---|---|
| (5% NaCl + 0.5% $CH_3COOH$) Solution + $H_2S$ ; NACE Condition | 3.6 | 2800 ~ 3200 | 25 | 500 | W: 50 L: 100 T: 23.5 (2 pcs. each) |

The test pieces were sampled from the steel plate at the position corresponding to the center in thickness of the initial slab so as to avoid variation in total rolling conditions of the test pieces.

As shown in Table 4, each test piece was immersed with no stress load in a solution of 5% NaCl+0.5% $CH_3COOH$ saturated by $H_2S$ for 500 hours, divided in the surface area into 50 equal portions (10 mm×10 mm) and ultrasonic inspection was conducted in each portion to detect cracks. After ultrasonic inspection, each test piece was microscopically inspected with respect to at least one section to determine the existence of hydrogen induced cracks.

Table 5 shows the results of the tests. As clearly seen from Table 5, the steel plates according to the present invention marked A-1, A-4, B-1 and B-2 are completely free from hydrogen induced cracks irrespective of the difference in the conditions of their heat treatment.

TABLE 5

| | Mark | No. | Cracking Ratio (%) Just Rolled | Annealed (1)* | Annealed (2)* | Hardened & Tempered (3)* |
|---|---|---|---|---|---|---|
| Present Invention | | 1 | 0 | 0 | 0 | 0 |
| Conventional Method | | 2 | 28 | 24 | 18 | 6 |
| | A | 3 | 36 | 32 | 40 | 12 |
| Present Invention | | 4 | 0 | 0 | 0 | 0 |
| Conventional Method | | 5 | 12 | 18 | 22 | 6 |
| | | 6 | 16 | 16 | 14 | 10 |
| Present Invention | | 1 | 0 | 0 | 0 | 0 |
| | | 2 | 0 | 0 | 0 | 0 |
| | B | 3 | 10 | 8 | 6 | 2 |
| Conventional Method | | 4 | 14 | 14 | 8 | 6 |
| | | 5 | 8 | 22 | 12 | 10 |
| | | 6 | 24 | 18 | 26 | 12 |
| Conventional Method | | 1 | 26 | 32 | 22 | 8 |
| | C | 2 | 32 | 44 | 28 | 16 |
| | | 3 | 58 | 68 | 46 | 22 |

Figure 4:
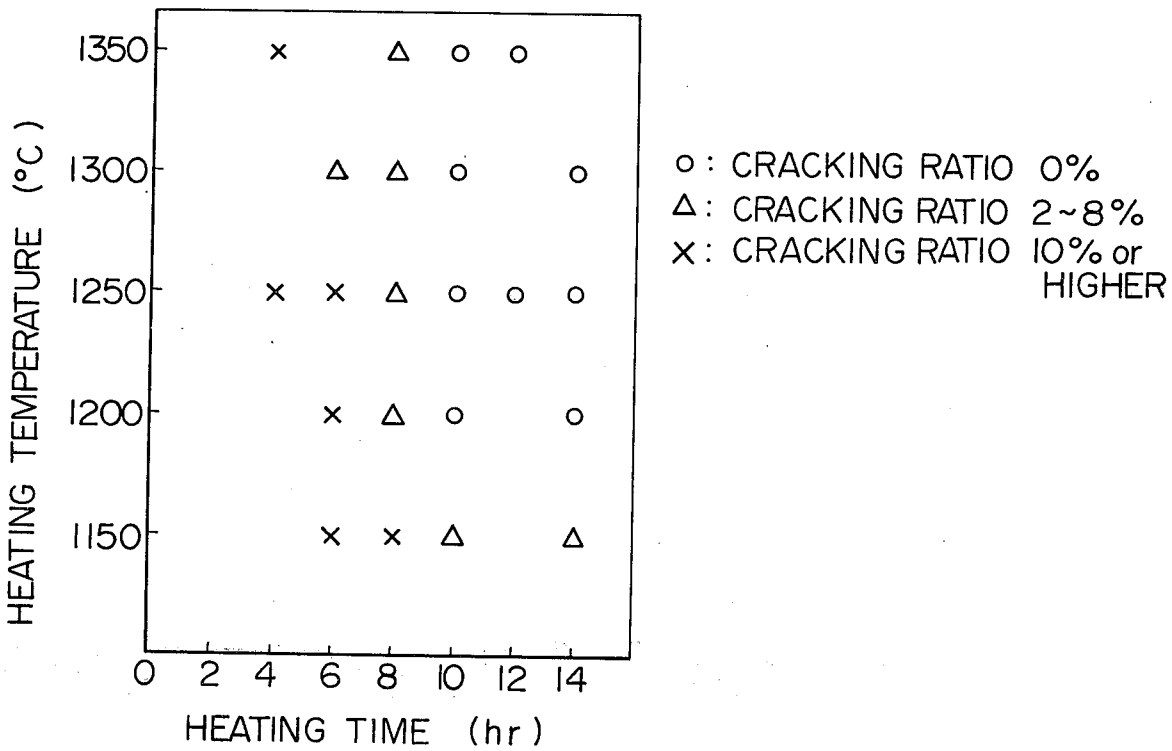
FIG. 4 is a diagram showing the relation among the heating temperature and the heating time of the slab after the primary reduction rolling according to the present invention and the hydrogen induced cracking ratio of the steel plate after the final rolling.

*(1) 620° C. × 60 min. AC
(2) 920° C. × 60 min. AC
(3) 920° C. × 60 min. WQ → 620° C. × 60 min. AC As described hereinabove, FIG. 4 shows the relation among the heating temperature and the heating time of the slab after the primary reduction rolling according to the present invention and the hydrogen induced cracking ratio of the steel plate after the final rolling. As clearly seen from FIG. 4, no particular effect for preventing hydrogen induced cracking was obtained from the heating condition of the heating temperature lower than 1200° C. and the heating time less than 10 hours. In the heating condition of lower than 1200° C., that is 1150° C., but longer than 10 hours, the central segregation was reduced to possibly prevent hydrogen induced cracking. In this heating condition, however, the productivity is very low and is disadvantageous on an industrial scale.

While we have described and illustrated a present preferred method of practicing the invention, it is to be distinctly understood that the invention is not limited thereto but may be otherwise variously practiced within the scope of the following claims.

What is claimed is:

1. A method for producing a steel plate having resistance to hydrogen induced cracking, comprising the steps of:

providing a continuously cast steel slab containing 0.01 to 0.30% by weight of C, 0.05 to 0.60% by weight of Si, 0.40 to 2.50% by weight of Mn, 0.005 to 1.00% by weight of Sol Al, up to 0.003% by weight of S, and Ca in an amount such that the weight ratio of Ca/S is 2 to 10, the remainder being substantially iron;

subjecting said slab to hot primary reduction rolling at a temperature of from 1100° to 1300° C. to reduce the thickness of said slab to 50% or less of its original thickness;

heating the rolled slab at a temperature of 1200° C. or higher for 10 hours or longer; and hot rolling the thus heated slab.

2. A method according to claim 1, wherein said continuously cast slab further contains at least one of Nb 0.06% or lower by weight, V 0.10% or lower by weight, Cu 0.5% or lower by weight, Ni 9.5% or lower by weight, and Cr 1.0% or lower by weight.

3. A method according to claim 1, wherein said hot primary reduction rolling reduces the thickness of said slab to within the range from one-half to one-third of its original thickness.

4. A method according to claim 1, wherein said heating of said rolled slab is carried out at a temperature of 1200° to approximately 1360° C. for 10 to 24 hours.

5. A method according to claim 1, wherein said cast slab contains 0.0020 to 0.0100% by weight of Ca.

* * * * *